US009932808B2

(12) United States Patent
Sheng

(10) Patent No.: US 9,932,808 B2
(45) Date of Patent: Apr. 3, 2018

(54) LIQUID OIL PRODUCTION FROM SHALE GAS CONDENSATE RESERVOIRS

(71) Applicant: TEXAS TECH UNIVERSITY SYSTEM, Lubbock, TX (US)

(72) Inventor: James J. Sheng, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 0 days.

(21) Appl. No.: 15/318,281

(22) PCT Filed: Jun. 11, 2015

(86) PCT No.: PCT/US2015/035349

§ 371 (c)(1),
(2) Date: Dec. 12, 2016

(87) PCT Pub. No.: WO2015/191864

PCT Pub. Date: Dec. 17, 2015

(65) Prior Publication Data

US 2017/0122086 A1 May 4, 2017

Related U.S. Application Data

(60) Provisional application No. 62/011,340, filed on Jun. 12, 2014.

(51) Int. Cl.
*E21B 43/16* (2006.01)

(52) U.S. Cl.
CPC ..... *E21B 43/168* (2013.01); *E21B 43/164* (2013.01)

(58) Field of Classification Search
None
See application file for complete search history.

(56) References Cited

U.S. PATENT DOCUMENTS 3,617,471 A * 11/1971 Schlinger ..... C10G 1/002 166/266
4,548,267 A * 10/1985 Sheffield ..... E21B 43/168 166/268
4,615,392 A * 10/1986 Harrigal ..... E21B 43/164 166/401
5,076,357 A * 12/1991 Marquis ..... C09K 8/594 166/268
5,899,274 A * 5/1999 Frauenfeld ..... E21B 43/16 166/305.1
9,605,522 B2 * 3/2017 Zubrin ..... E21B 43/164
2004/0026076 A1 * 2/2004 Goodwin ..... E21B 34/08 166/66.6
2009/0242204 A1 * 10/2009 Buijse ..... E21B 43/32 166/302

(Continued)

OTHER PUBLICATIONS

Holme A.; Optimization of Liquid-Rich Shale Wells; Jun. 2013; NTNU; 117 Pages.*

*Primary Examiner* — Anuradha Ahuja
(74) *Attorney, Agent, or Firm* — Dickinson Wright PLLC; Ross Spencer Garsson

(57) ABSTRACT

A process of producing liquid oil from shale gas condensate reservoirs and, more particularly, to increase liquid oil production by huff-n-puff in shale gas condensate reservoirs. The process includes performing a huff-n-puff gas injection mode and flowing the bottom-hole pressure lower than the dew point pressure.

25 Claims, 13 Drawing Sheets

(56) References Cited

U.S. PATENT DOCUMENTS

| | | | | |
|---|---|---|---|---|
| 2009/0288881 | A1* | 11/2009 | Mullins | E21B 7/04 175/50 |
| 2010/0252271 | A1* | 10/2010 | Kelley | E21B 43/122 166/370 |
| 2012/0018167 | A1* | 1/2012 | Konopczynski | E21B 47/102 166/369 |
| 2012/0090838 | A1* | 4/2012 | Collins | E21B 43/164 166/266 |
| 2012/0285700 | A1* | 11/2012 | Scott | E21B 43/305 166/369 |
| 2012/0318533 | A1* | 12/2012 | Keller | E21B 41/0064 166/402 |
| 2013/0105179 | A1* | 5/2013 | Lieberman | E21B 41/0064 166/402 |
| 2014/0318773 | A1* | 10/2014 | Kennel | E21B 43/25 166/270 |

* cited by examiner

LIQUID OIL PRODUCTION FROM SHALE GAS CONDENSATE RESERVOIRS

CROSS-REFERENCE TO RELATED PATENT APPLICATIONS

This application claims priority benefits to U.S. Patent Application Ser. No. 62/011,340, entitled "Liquid Oil Production From Shale Gas Condensate Reservoirs," filed on Jun. 12, 2014. This provisional application is commonly assigned to the Assignee of the present invention and is hereby incorporated herein by reference in its entirety for all purposes.

GOVERNMENTAL INTEREST

This invention was made with United States Government support under Grant No. DE-FE0024311 awarded by the Department of Energy and the Texas Tech University Shale EOR Consortium. The Government may have certain rights in the invention.

FIELD OF INVENTION

The present invention generally relates to the production of liquid oil from shale gas condensate reservoirs. More particularly, the present disclosure relates to increasing liquid oil production by huff-n-puff in shale gas condensate reservoirs.

BACKGROUND

Huge shale resources available and low gas price turn the oil operators' activities to producing more liquid oil. Common enhanced oil recovery methods can be divided along three different techniques: thermal injection, gas injection, and chemical injection to extract oil from the reserves.

Thermal injection uses hot water and steam to extract crude oil from the reservoir. Thermal injection is used for heavily viscous oil that cannot flow on its own, as the increased temperature reduces the oil's viscosity. Thermal injection has dominated the oil recovery market for 2012 and is utilized heavily by Canada, Indonesia, and California. [TMR 2014]. However, given the high price of the natural gas that is needed to heat the steam, its market share is expected to decrease during the next decade.

Gas injection technology injects gases to extract oil. The most common used gas is carbon dioxide ($CO_2$) since it is an abundant byproduct of industrial processes. In Northern America, many of the carbon dioxide enhanced oil recovery projects are concentrated in West Texas.

Chemical injection technology uses polymer, surfactant solution and alkali to extract crude oil from the reservoirs and can be incorporated in conjunction with another injection method for further efficiency.

Presently, North America leads the World in the enhanced oil recovery market, followed by Europe (especially Russia). Currently, it appears there is no necessity for the Middle East to utilize enhanced oil recovery methods for oil extraction (given the region's abundant resources), this is expected to change and it is anticipated that enhanced oil recovery will play a significant role in the Middle East in the coming years.

Currently, to produce a conventional (high-permeability) gas condensate, the conventional practice is inject gas and/or water to flood the gas condensate while maintaining the lower bottom-hole flowing pressure above the dew point pressure. Maintaining the flowing pressure above the dew point pressure is vital since it will prevent the formation of liquid from the initial gas phase, a phenomenon known as retrograde condensate. If this phenomenon were to occur, then valuable oil will be lost since it is more difficult for the formed residual oil saturation to flow to the surface and the formed oil near the wellbore will block further gas flow.

However, keeping the flowing pressure above the dew point results in a lower pressure difference between the reservoir and the flowing pressure. This pressure difference represents the driving force and needs to be high to ensure a higher oil production rate.

Generally when pressure is reduced, a liquid will vaporize to become a gas. However, in some special situation, when the pressure is reduced below a dew point pressure, a liquid forms from an initial gas phase. For instance, such phenomenon would occur by a pressure drop shown in the graph of FIG. 1 from point A to point B. This phenomenon is called retrograde condensate. Such reservoir is called gas condensate reservoir where initially the fluid is in gas state in reservoir. To produce the gas condensate, the conventional practice is to maintain the reservoir pressure or even the bottom-hole well pressure of the production well above the dew point pressure by gas and/or water flooding [Hernandez 1999]. The reason is that, if the reservoir pressure is allowed to decline below the dew point, a considerable volume of valuable condensate may be lost in the reservoir because oil saturation is formed and it is more difficult for the liquid to flow to the surface compared with gas. When oil saturation is below a residual oil saturation, oil cannot be produced using a conventional producing method. In addition, gas productivity declines rapidly once the liquid is formed near the wellbore, because the liquid will block gas flow [Thomas 1995].

In a shale or tight gas condensate reservoir where the formation permeability is very low (nano-Darcy or micro-Darcy), if the well flowing pressure and/or the reservoir pressure is above the dew point pressure, the pressure difference between the reservoir pressure and well flowing pressure which is the drive force to produce gas condensate will be small, especially when the initial reservoir pressure is near the dew point pressure. Then the production rate will be low and the resulting total hydrocarbon recovery will be low as well.

To increase reservoir pressure, there are two methods: gas flooding and huff-n-puff. In the gas flooding, gas is injected through an injector, and fluids are produced from another producer. In the huff-and-puff gas injection, gas is injected to the reservoir through a well during the huff period, and fluids are produced from the same well during the puff period.

Gaseous or gaseous/liquid recovery fluid methods of hydrocarbons is generally divided into two mechanism: (a) drive processes or flooding processes and (b) cyclic processes. The cyclic processes are also known as "huff-n-puff" or "push/pull." In drive oil recovery processes, injection and production of fluids occur at different wells. In huff-n-puff processes, injection and production of fluids occur through the same well. Besides those structural differences, drive and huff-n-puff processes are substantially different in that the design of slugs of recovery fluid, times of recovery, well patterns, costs, fluid velocities, and other factors are different. Examples of huff-n-puff processes are described and taught in Patton '068 patent, Russum '689 patent, Wehner '863 patent, Shayegi '054 patent, and Miller '431 patent.

In Applicant's recent work of huff-n-puff gas injection in shale oil reservoirs [Sheng 2014; Wan 2013 A; Wan 2013 B;

Gamadi 2013; Wan 2014; Gamadi 2014], the pressure effect on oil recovery was studied. It is perceived that, when the flowing pressure is above the minimum miscibility pressure (MMP), the injected gas will be fully miscible with the in-situ oil. Then the oil viscosity will be decreased to the minimum, and the oil will swell to the maximum. The oil recovery will be high. It appears that one of the dominant mechanisms is pressure maintenance. According to the discussions and definitions in Sheng 2011, if the dominant mechanism is pressure maintenance, the gas injection process belongs to improved oil recovery (IOR). If the dominant mechanism is related to miscible flooding, the gas injection process belongs to enhanced oil recovery.

However, the simulation results shown in FIG. 2 show that higher oil recovery is obtained if a lower bottom-hole flowing pressure (BHFP) is used, even though the flowing pressure is lower than the MMP. (For 500 psi, 1000 psi, 1500 psi, and 2500 psi, these are respectively (a) oil recover factors curves 201-204 and (b) oil rates curves 205-208). The main reason is that as the flowing pressure is lower, the pressure difference between the reservoir and this flowing pressure (drive force) will be higher, so that flow rate will be higher according to Darcy's law.

Similarly, in gas condensate reservoirs, to increase gas and oil production, the pressure drop should be high. The wellbore flowing pressure will be lower than the dew point pressure. When that occurs, the liquid oil will be accumulated at the wellbore and the resulting gas saturation will be low. Then gas condensate rate will be lower, the corresponding liquid oil rate will be low as well.

The current available technique to produce gas condensate shale reservoirs is through primary depletion using horizontal wells with multiple transverse fractures. No IOR or EOR methods have been implemented in shale reservoirs. Juell and Whitson [Juell 2013] did simulation work to find optimal operation conditions for gas condensate shale reservoirs is in the depletion mode. They found that the optimal production strategy for wells producing from highly undersaturated gas condensate reservoirs is likely to have an initial period where the flowing pressure equals the saturation pressure, followed by a gradual increase in drawdown, towards the minimum bottom-hole pressure that is operationally possible. When that occurs, the liquid oil will be accumulated at the wellbore, and the resulting gas saturation will be low. Then gas condensate rate will be lower, and the corresponding liquid oil rate will be low as well. To solve this problem, the condensate in conventional condensate reservoirs is re-vaporized by lean gas flooding. [Standing 1948; Weinaug 1949; Smith 1968, nitrogen (Aziz 1982) or $CO_2$ (Chaback 1994; Goricnik 1995)].

However, in shale and tight reservoirs, formation permeability is so low that any flooding (gas flooding and water flooding) may not be feasible because the pressure drop from an injector to a producer is large and thus it is very difficult for the pressure to transport from the injector to the producer. For the huff-n-puff, a quick response from gas injection is expected. The injected gas will increase the pressure near the producer, thus the drive energy is boosted. The increased pressure may vaporize the liquid dropout near the producer. However, there is a concern that the injected gas during the huff period will be re-produced during the puff period.

Thus, there is a need to solve the ultra-low permeability problem in shale reservoirs where gas flooding or water flooding is not feasible to maintain reservoir pressure particularly because liquid oil will drop out in the reservoir and become difficult to produce when the reservoir pressure is low.

SUMMARY OF INVENTION

The present invention generally relates to the production of liquid oil from shale gas condensate reservoirs. A method has been discovered for producing gas condensate reservoirs to solve the low-permeability problem, to increase the production drawdown (production rate), and to increase liquid oil offtake. This method includes performing a huff-n-puff gas injection mode and flowing the bottom-hole pressure lower than the dew point pressure.

The present invention thus provides an increase (and can maximize) liquid oil offtake and production while ensuring that the phenomenon of retrograde condensate does not occur through huff-n-puff gas injection.

The huff-n-puff injection of produced gases of the present invention can produce more liquid oil in gas condensate reservoirs than gas flooding or primary depletion. The advantages of huff-n-puff over gas flooding are the early response to gas injection, high drawdown pressure, oil saturation decrease near the wellbore by evaporation, and overcoming the pressure transport problem owing to ultra-low permeability. The advantages become more important when the initial reservoir pressure is close to the dew point pressure, or the bottom-hole flowing pressure is low.

Such advantages further include: (A) Huff-n-puff injection of produced gases can produce more liquid oil in gas condensate reservoirs than gas flooding or primary depletion. All the cases with different reservoir and fluid properties and operation conditions show this result. (B) The advantages of huff-n-puff over gas flooding are early response to gas injection, high drawdown pressure, oil saturation decrease by evaporation, and overcoming the pressure transport problem owing to ultra-low permeability. (C) The advantages of huff-n-puff over gas flooding become more important when the initial reservoir pressure is close to the dew point pressure, or the bottom-hole flowing pressure is low. (D) $CO_2$ injection may not be superior to lean gases in terms of oil recovery in gas condensate reservoirs. (E) There is an optimum cycle time for oil recovery, and it may not be necessary to have a soak period.

In general, in one aspect, the invention features a method of producing hydrocarbons from a shale gas condensate reservoir. The method includes determining dew point pressure of fluids in a reservoir formation. The method further includes injecting gas from the surface downhole into a wellbore of a well such that the injected gas flows from bottom-hole into the reservoir formation. The step of injecting occurs over a first time period of a cycle period. The method further includes producing fluids from the same wellbore by flowing the fluids from the reservoir formation into the bottom hole and up hole to the surface. The bottom hole flowing pressure is below the dew point pressure of the fluids in the reservoir formation. The production of the fluids occurs over a second time period of a cycle period. The method further includes repeating above identified injection and production steps for a plurality of cycle periods.

Implementations of the invention can include one or more of the following features:

The hydrocarbons can be liquid oil.

The shale gas condensate reservoir can have a permeability of the reservoir formation that is at most 50 mD.

The permeability can be at most 0.1 mD.

The permeability can be at most 100 nD.

The gas can be selected from the group consisting of methane, natural gas, carbon dioxide, nitrogen, and combinations thereof.

The gas can include methane.

The gas can include carbon dioxide.

The pressure at which the gas is injected into the reservoir formation can be below fracture pressure of the reservoir formation.

The cycle period can be at most 200 days.

The cycle period can be between 25 and 100 days.

The method can further include selecting the durations of the first time period and the second time period based upon a parameter selected from the group consisting of permeability of the reservoir formation, composition of the gas, composition of the fluids in the reservoir formation, the dew point pressure of the fluids in the reservoir formation, the bottom-hole flowing pressure, production rate, the bottom-hole injection pressure, the bottom-hole injection rate, facility constraints, economic parameters, and combinations thereof.

The method can further include that the parameter is an economic parameter of net present value of the fluids produced.

There can be no soaking period between the first period and the second period.

There can be a soak period between the first period and the second period.

The soak period can be for a period of time that is at most the time of the first period.

The production of the liquid oil from the wellbore using the method and the production of the liquid oil from the wellbore before the method was used can be at a liquid oil ratio of least around 1.2.

The liquid oil ratio can be at least around 1.5.

The production of net gas from the wellbore using the method and the production of gas from the wellbore before the method was used can be at a gas ratio of least around 1.3. The net gas is the amount of gas produced during the second time period less the amount of gas injected during the first time period.

The gas ratio can be at least around 2.

The bottom hole flowing pressure can be at most 2500 psi.

The bottom hole flowing pressure can be at most 500 psi.

Durations of the first time period and the second time period can be the same for each cycle period in the plurality of cycle period.

Duration of the first time periods can be the same for each cycle period in the plurality of cycle periods. Duration of the second time periods can be the same for each cycle period in the plurality of cycle periods.

Duration of at least some of the first time periods can be different for each cycle period in the plurality of cycle periods. Duration of at least some of the second time periods can be different for each cycle period in the plurality of cycle period.

BRIEF DESCRIPTION OF THE DRAWINGS

For better understanding of the present invention, and the advantages thereof, reference is now made to the following descriptions taken in conjunction with the accompanying drawings.

DETAILED DESCRIPTION

The present invention generally relates to the production of liquid oil from shale gas condensate reservoirs. More particularly, the present disclosure relates to increasing liquid oil production by huff-n-puff in shale gas condensate reservoirs.

The potentials of gas flooding and huff-n-puff gas injection to enhance oil recovery in shale oil reservoirs has recently been compared by applicant. [Sheng 2014]. In Applicant's simulation work, Applicant used the same grid model used, except that gas condensate compositions were used in place of the black oil model. The method of the present invention was simulated using a compositional simulator (GEM—Composition & Unconventional Reservoir Simulator, developed by Computer Modelling Group Ltd. (Calgary, Alberta, Canada)).

Figure 3:
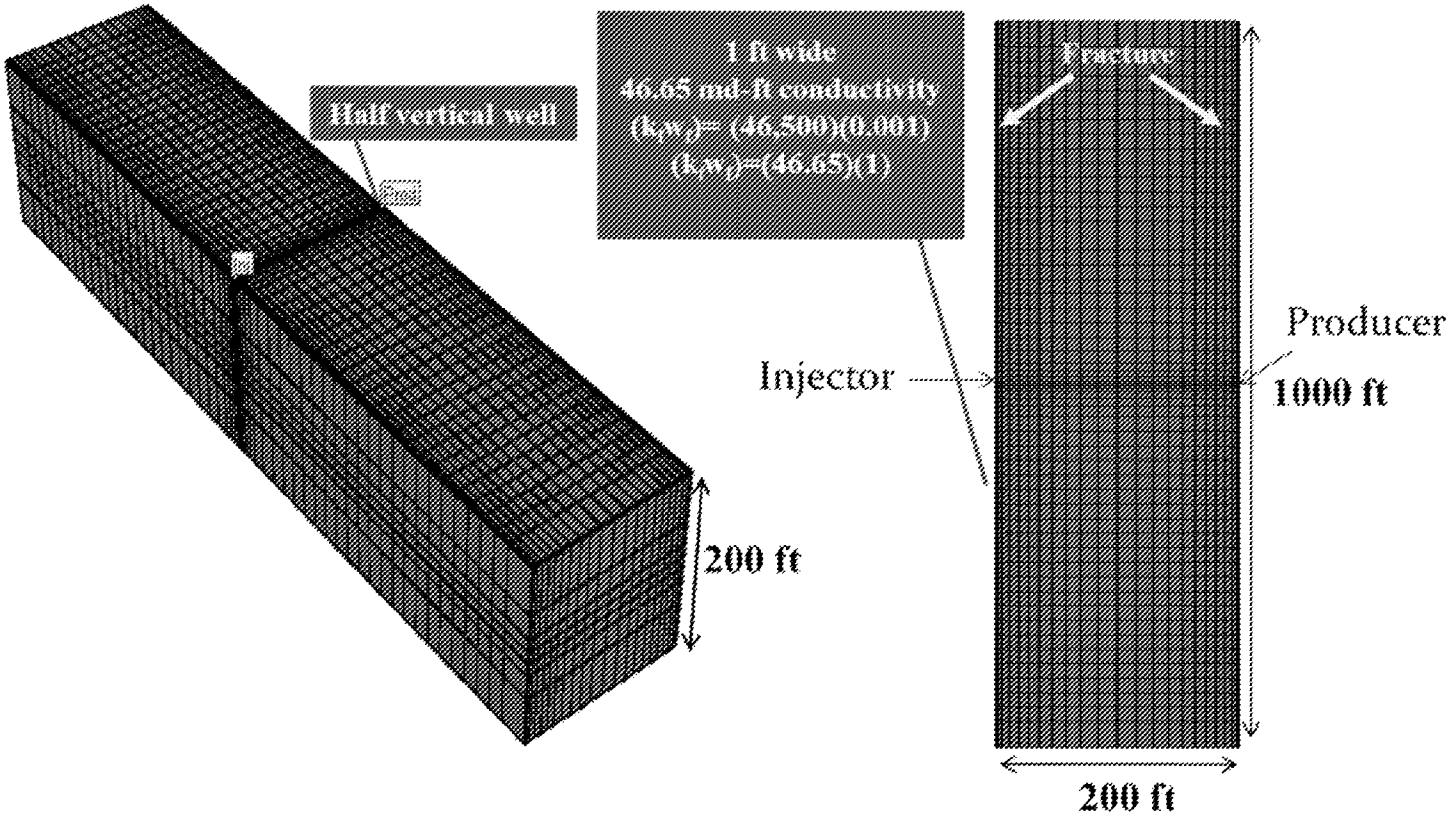
FIG. 3 is the simulation model grid set up for a simulation performed of an embodiment of the present invention.

The gas condensate composition was from Orangi 2011 (as re-presented in TABLE 1) and the simulator related reservoir and fluid parameters are shown in FIG. 3.

TABLE 1

Peng-Robinson EOS Fluid Description of Eagle Ford Condensate (Orangi 2011)

| Components | Initial Comp. (mole frac) | $P_c$ (atm) | $T_c$ (deg. K) | Acentric Fac. (dimensionless) | MW (g/mole) | $V_c$ (l/mol) |
|---|---|---|---|---|---|---|
| C1 | 0.65882 | 45.4 | 190.6 | 0.013 | 16.04 | 0.099 |
| N2 | 0.00154 | 33.5 | 126.0 | 0.04 | 28.01 | 0.089 |
| C2 | 0.08337 | 48.2 | 305.4 | 0.0986 | 30.07 | 0.148 |
| C3 | 0.0467 | 41.9 | 369.8 | 0.1524 | 44.09 | 0.203 |
| CO2 | 0.02686 | 72.8 | 304.2 | 0.225 | 44.01 | 0.094 |
| IC4 | 0.01045 | 36.0 | 408.1 | 0.1848 | 58.12 | 0.263 |
| NC4 | 0.01825 | 37.5 | 425.2 | 0.201 | 58.12 | 0.255 |
| IC5 | 0.00825 | 33.4 | 460.4 | 0.2223 | 72.15 | 0.306 |
| NC5 | 0.00791 | 33.3 | 469.6 | 0.2539 | 72.15 | 0.304 |
| NC6 | 0.01194 | 32.46 | 507.5 | 0.3007 | 86.18 | 0.344 |
| C7+ | 0.07627 | 27.8 | 584.1 | 0.3673 | 112 | 0.446 |
| C11+ | 0.04551 | 20.2 | 692.1 | 0.5491 | 175 | 0.685 |
| C15+ | 0.00278 | 17.62 | 737.5 | 0.6435 | 210 | 0.809 |
| C20+ | 0.00135 | 15.39 | 781 | 0.7527 | 250 | 0.942 |

In TABLE 1, $P_c$, $T_c$ and $V_c$ are critical pressure, critical temperature and critical volume, respectively, and MW is molecular weight. Because of flow symmetry, two half-fractures along the left and right boundaries were simulated. These two half-fractures are the equivalent of one fracture. One half-fracture is connected to the injector, while the other half-fracture is connected to the producer. A fracture of 2-ft width was used to represent the real fracture of 0.001 ft, and the fracture permeability was reduced from 83,000 mD to 46.5 mD based on the concept of equivalent fracture conductivity ($k_f w_f$) [Rubin 2010].

Figure 1:
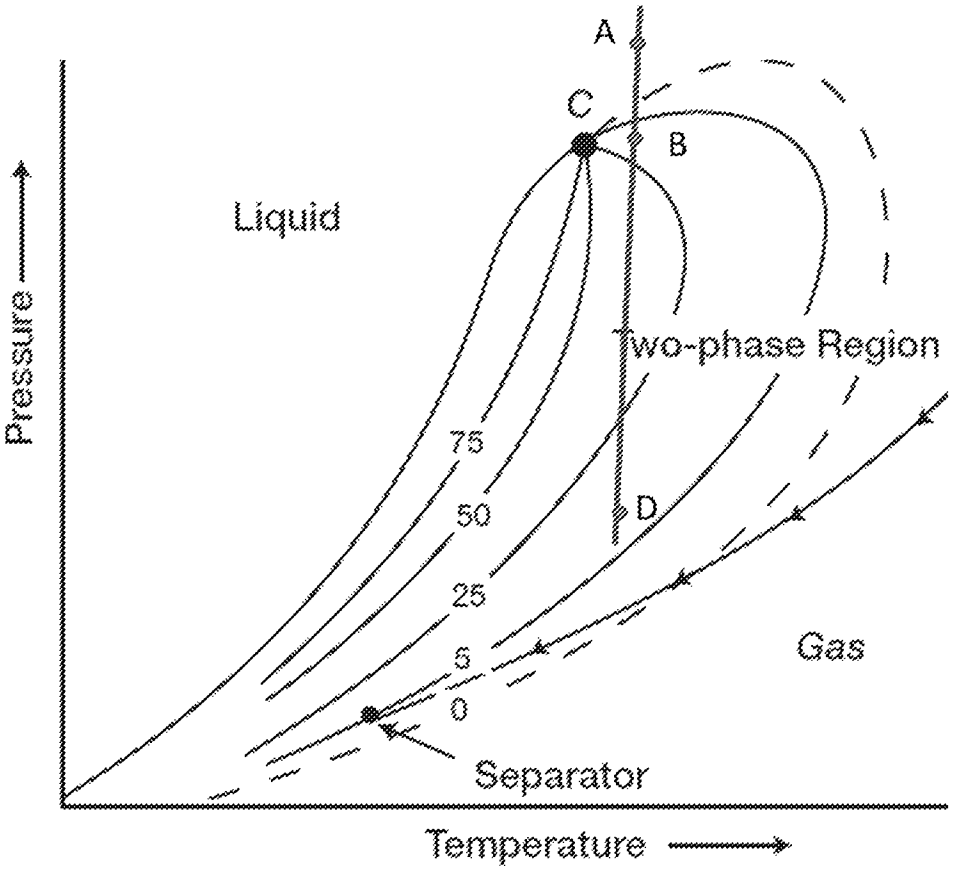
FIG. 1 is a graph illustrating an example of p-T diagram of a retrograde condensate.
Figure 9A:
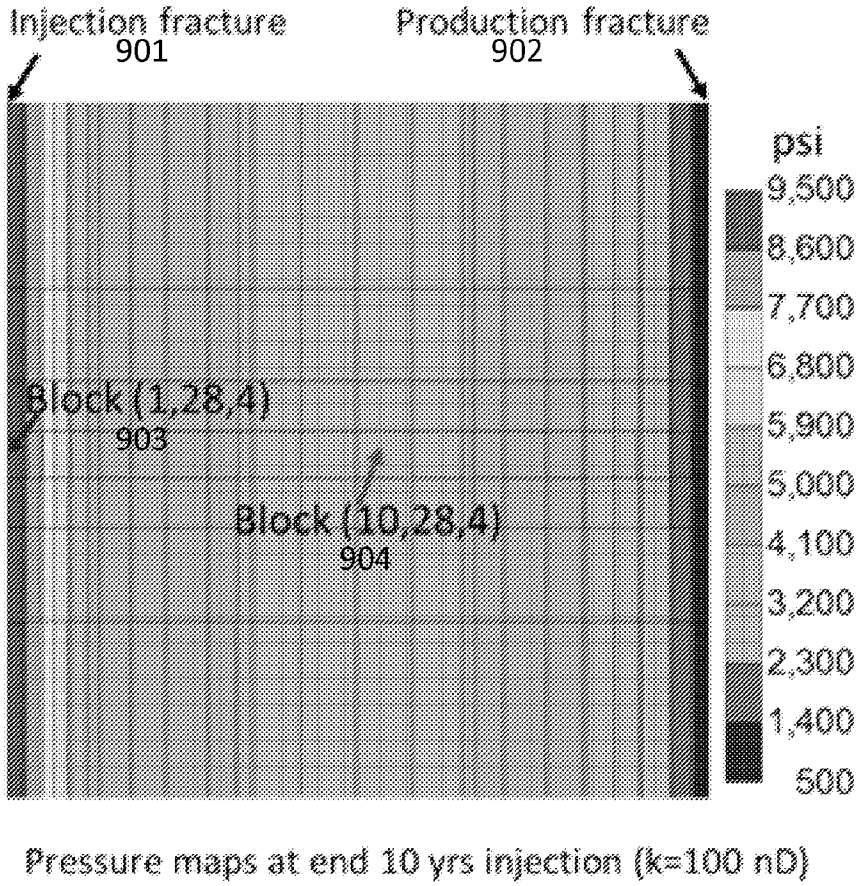
FIGS. 9A-9B illustrate pressure distributions at the end of 10 year injection for two permeability reservoirs (having permeabilities of 100 nD to 0.1 mD, respectively).
Figure 9B:
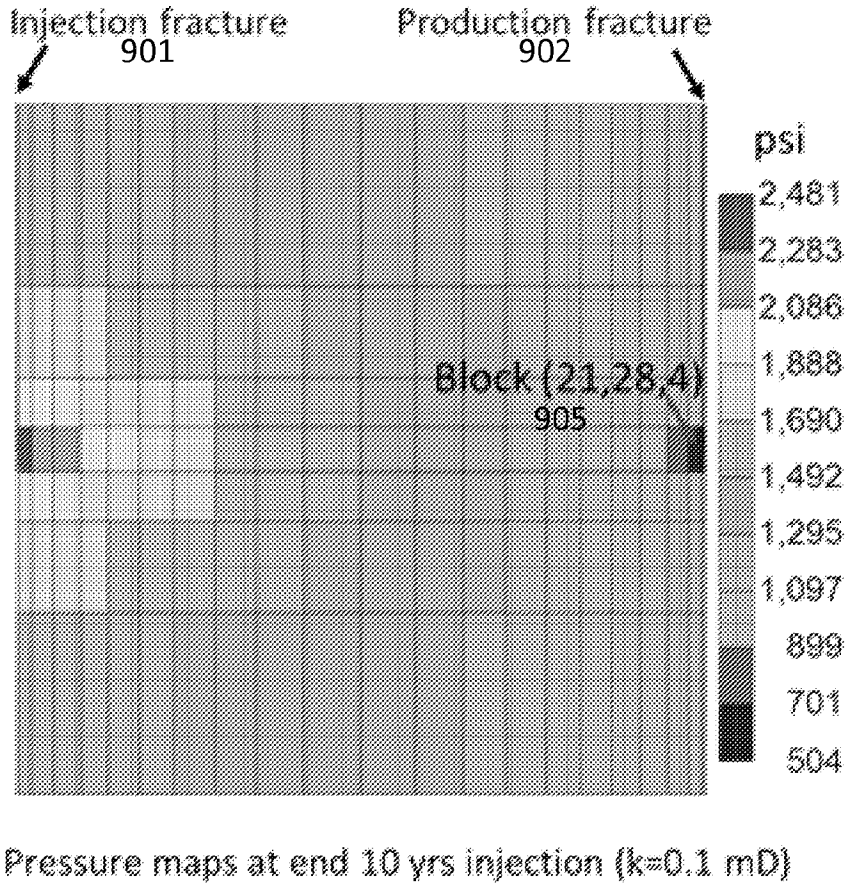

The concept of equivalent fracture conductivity is that the fracture conductivity ($k_f w_f$) in the model of 46.5×2=83 mD·ft is equal to the conductivity of real fracture which is 83000×0.001=83 mD·ft. The fracture length is 1000 ft. represented by 55 blocks in the J direction of the simulation grid. The formation height and the fracture height are the same, 200 ft, represented by 7 blocks in the K direction. The fracture spacing is 200 ft. The locations of two half-fractures in the gas flooding mode are in the most-left and most-right blocks in the I direction as shown in FIG. 1 and FIGS. 9A-9B. The location of a single fracture in the huff-n-puff mode is in the middle of the model, as schematically shown in FIGS. 9A-9B. Total 22 blocks are used in the I direction in the gas flooding mode and 21 blocks in the I direction for the huff-n-puff mode. For the gas flooding, the injector is located at I=1 and the producer at I=22. For the huff-n-puff, the injector and producer (same well) is located at I=11 The well locations in the XY plan are schematically shown in FIGS. 9A-9B. All the wells are perforated at the bottom layer (K=7) and in the middle in the J direction (J=28). The detailed block sizes are as follows.

The block sizes in feet in the I direction from I=1 to I=22 in the order (gas flooding mode) are:

| | | | | | | | | | | |
|---|---|---|---|---|---|---|---|---|---|---|
| 1, | 4, | 6, | 8, | 8, | 9, | 10, | 12, | 12, | 14, | 16, |
| 16, | 14, | 12, | 12, | 10, | 9, | 8, | 8, | 6, | 4, | 1 |

The block sizes in feet in the I direction from I=1 to I=21 in the order (primary and huff-n-puff modes) are:

| | | | | | | | | | | |
|---|---|---|---|---|---|---|---|---|---|---|
| 16, | 14, | 12, | 12, | 10, | 9, | 8, | 8, | 6, | 4, | 2, |
| 4, | 6, | 8, | 8, | 9, | 10, | 12, | 12, | 14, | 16 | |

The block sizes in feet in the J direction with total 55 blocks (all modes) are:

35, 21 blocks at 20 ft each, 16, 10, 8, 6, 4, 2, 4, 6, 8, 10, 16, 21 blocks at 20 ft each, 35

The block sizes in feet in the K direction from K=1 to K=7 in the order (all modes) are:

52.8, 26.4, 14.2, 13.2, 14.2, 26.4, 52.8

In this example, a single well and a single fracture are built in the model for the huff-n-puff and primary modes. Their block sizes in the I direction can be the same as those in the gas flooding mode, if two half-wells and two half-fractures are used. The results are unchanged because of the flow symmetry. [K. Chen 2013].

The formation height and the fracture height were the same, 200 ft. The properties of the reservoir properties used in the simulation are provided in TABLE 2.

TABLE 2

Reservoir and fluid properties used in the model

| | |
|---|---|
| Initial Reservoir Pressure | 9088 psi |
| Porosity of Shale Matrix | 0.06 |
| Initial Water Saturation | 0.2 |
| Compressibility of Shale | $5 \times 10^{-6}$ $psi^{-1}$ |
| Shale Matrix Permeability | 0.0001 md |
| Reservoir Temperature | 310° F. |
| Reservoir Thickness | 200 ft |
| Dew Point pressure | 3988 psi |

The following three scenarios were compared: (a) primary production, (b) gas flooding, and (c) huff-n-puff gas injection. In each scenario, primary production was implemented in the first 5 years, followed by 25 years of continued production. In the gas injection and gas huff-n-puff scenarios, the injected gas or recycled gas was methane. (Different injection gases, such as natural gas, carbon dioxide, nitrogen, and combinations thereof, can be used alternatively, or in additional, to methane in other embodiments of the present invention). The minimum bottom hole flowing pressure for the producer was 500 psi, and the maximum bottom hole injection pressure for the injector was 9500 psi. This injection pressure is a conveniently chosen value and close to the initial reservoir pressure 9088 psi. It is assumed to be below the fracture pressure. For the huff-n-puff mode, the injection and production cycle is 100 days, and there is no soaking time. TABLE 3 shows the simulation results for these base cases. The ratios of each parameter for the huff-n-puff scenario to that for the gas flooding scenario are also shown in this TABLE 3.

TABLE 3

Performance comparison of different scenarios (100 nD)

| | Primary | Gas Flooding | Gas huff-n-puff | Ratio (B/A) |
|---|---|---|---|---|
| Total gas produced (MMSCF) | 357.01 | 275.43 | 3133.7 | 11.38 |
| Gas injected (MMSCF) | 0 | 216.36 | 3008.3 | 13.90 |
| Net gas produced (MMSCF) | 357.01 | 59.07 | 125.4 | 2.12 |
| Oil produced (MSTB) | 30.385 | 36.5 | 46.666 | 1.28 |
| Oil recovery factor (%) | 26 | 31.23 | 39.93 | 1.28 |
| Value of produced oil and gas (MM$) | 4.466548 | 3.88628 | 5.1682 | 1.33 |

Figure 4:
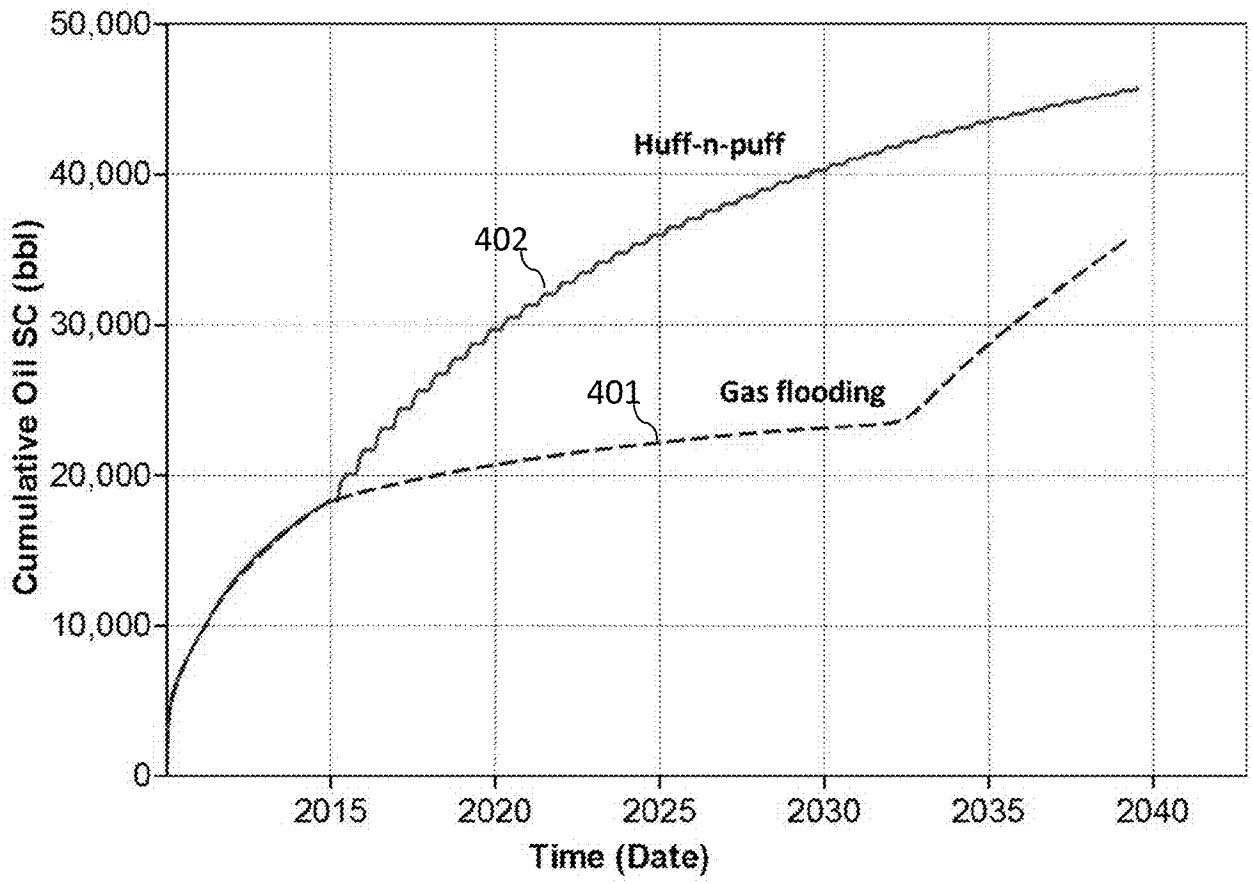
FIG. 4 is a graph showing cumulative oil production in the base case (gas flooding curve 401) and huff-n-puff (huff-n-puff curve 402).

From TABLE 3, it can be seen that the liquid oil recovery from gas huff-n-puff is 39.93%, almost 14% higher than that from the primary depletion, and about 9% higher than the gas flooding scenario. Assuming an oil price of $100/STB and a gas selling price of $4/MSCF, the huff-n-puff scenario showed the highest revenue. Although the primary depletion has higher revenue than the gas flooding, the liquid oil recovery is lower. In this economic calculation, the difference in capital investment and facility and operation costs were not included. A discount rate was not included either. When a discount rate is considered, the performance of huff-n-puff looks even better than gas flooding because the former responds to gas injection earlier, as FIG. 4 shows that the cumulative oil produced in the huff-n-puff scenario at the earlier days is higher than that in the gas flooding scenario. The simple economic analysis is conducted to compare the liquid oil production potentials between the huff-n-puff mode and gas flooding mode.

In the current North American market, the gas supply is higher than the demand. Increasing liquid oil production is the operators' interest. The results in TABLE 3 show that huff-n-puff gas injection can meet the operators' goal.

Figure 5:
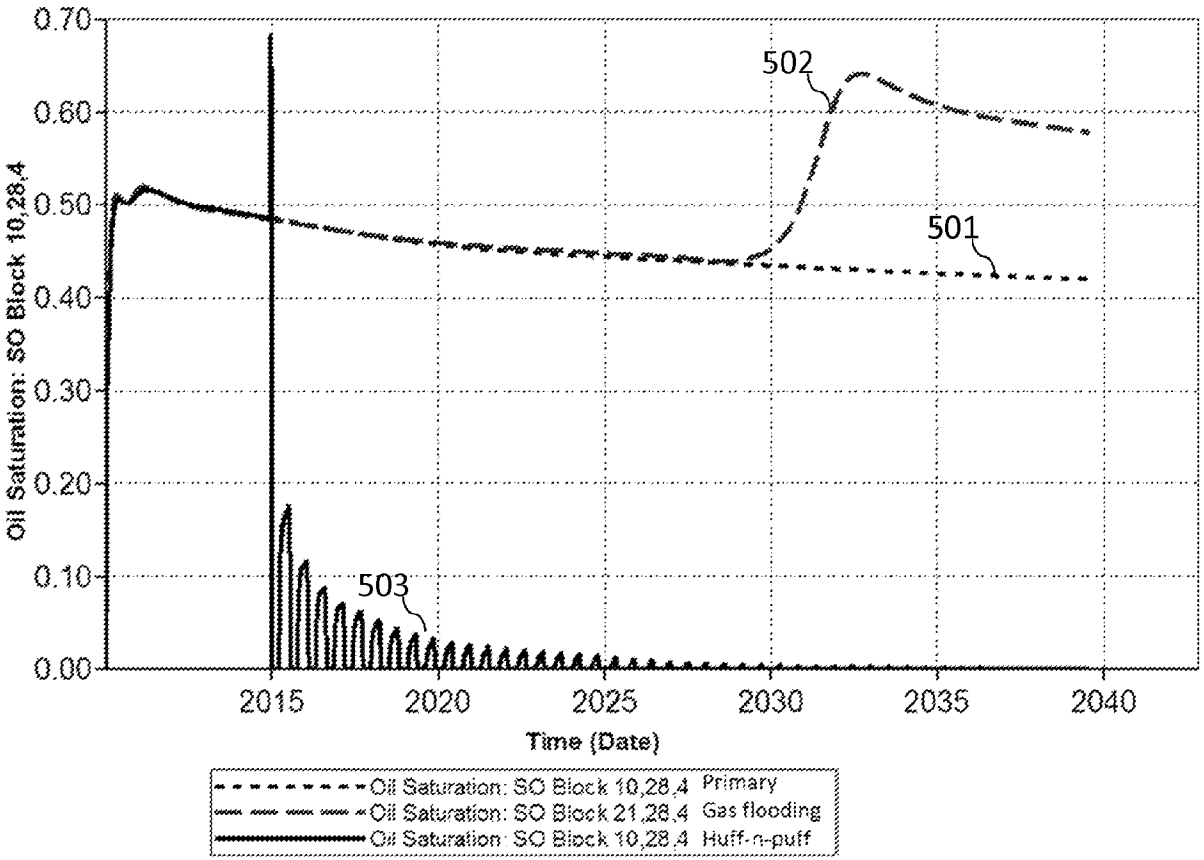
FIG. 5 is a graph showing the oil saturations near the producing fracture of the simulation that was set up as illustrated in FIGS. 9A-9B. Curves 501-503 show, respectively, the oil saturations SO for Block (10, 28, 4) primary, gas flooding, and huff-n-puff.

FIG. 5 shows the oil saturations near the producing fractures at Block (21, 28, 4) 905 for the gas flooding case as marked in FIG. 9B, and at Block (10, 28, 4) 904 in the middle of the model schematically marked in FIG. 9A. (The grids are not correct because the grids in FIGS. 9A-9B are for the gas flooding mode not for the huff-n-puff mode).

Figure 6:
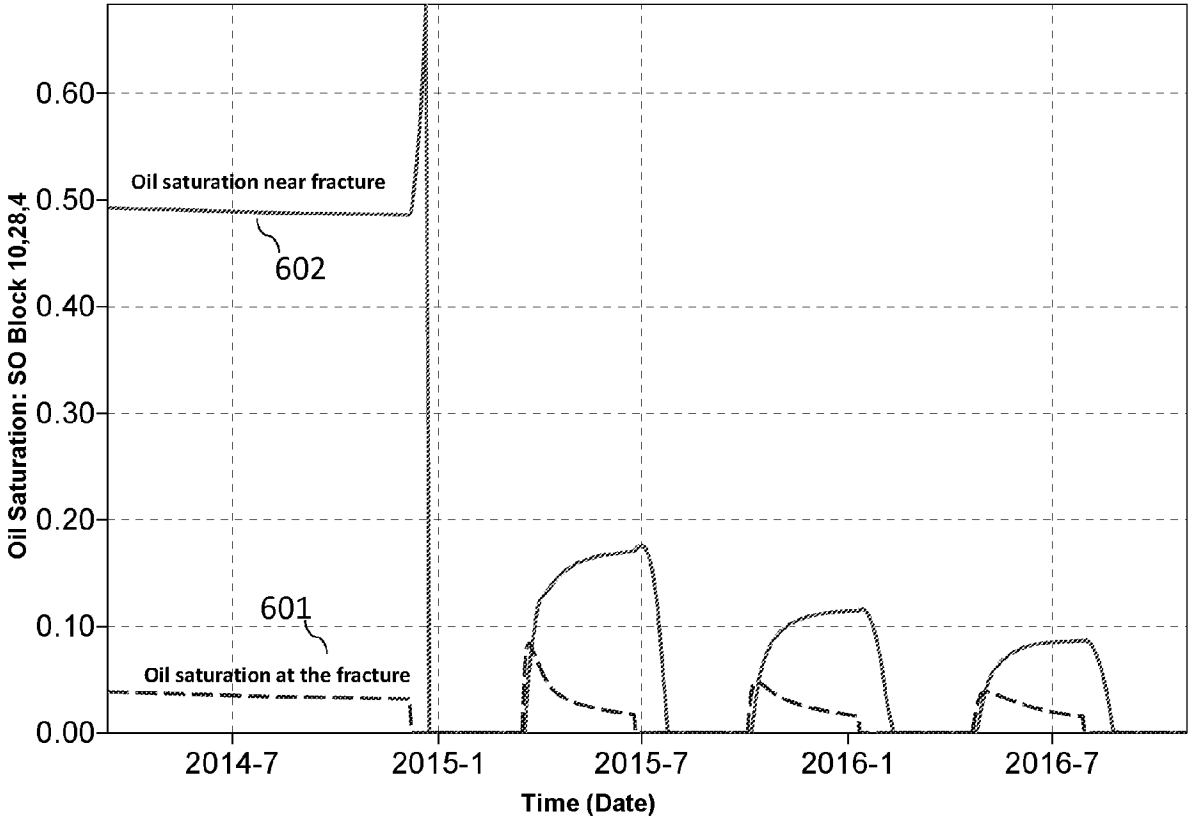
FIG. 6 is a graph showing oil saturation near (I=10) (curve 601) and at the producing fracture (I=11) (curve 602).

FIG. 5 shows that the oil saturation in the gas huff-n-puff case (curve 503) quickly decreases to very low values. At the end, the oil saturation is almost zero. In the primary and gas flooding cases (curves 501 and 502, respectively), the oil saturations remain high. It is noted that the oil saturation in the gas flooding case built up because the oil bank reaches the producing fracture. In the gas huff-n-puff case, the oil saturation suddenly shot up because some oil in the producing fracture was displaced to the block near the fracture during the gas injection period, as shown in FIG. 6.

Figure 7:
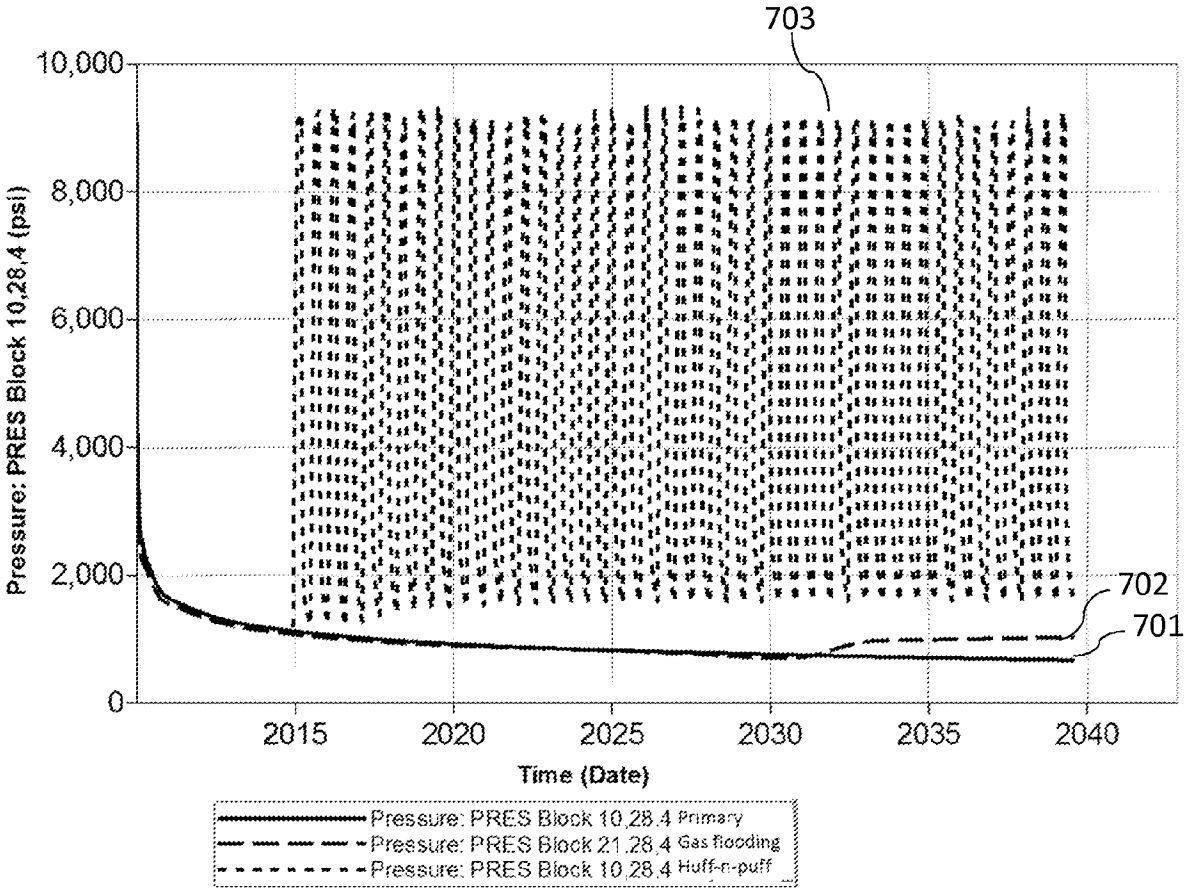
FIG. 7 shows the pressure near fracture of the simulation that was set up as illustrated in FIGS. 9A-9B. Curves 701-703 show, respectively, the pressure for PRES Block (10, 28, 4) primary, gas flooding, and huff-n-puff.
Figure 8:
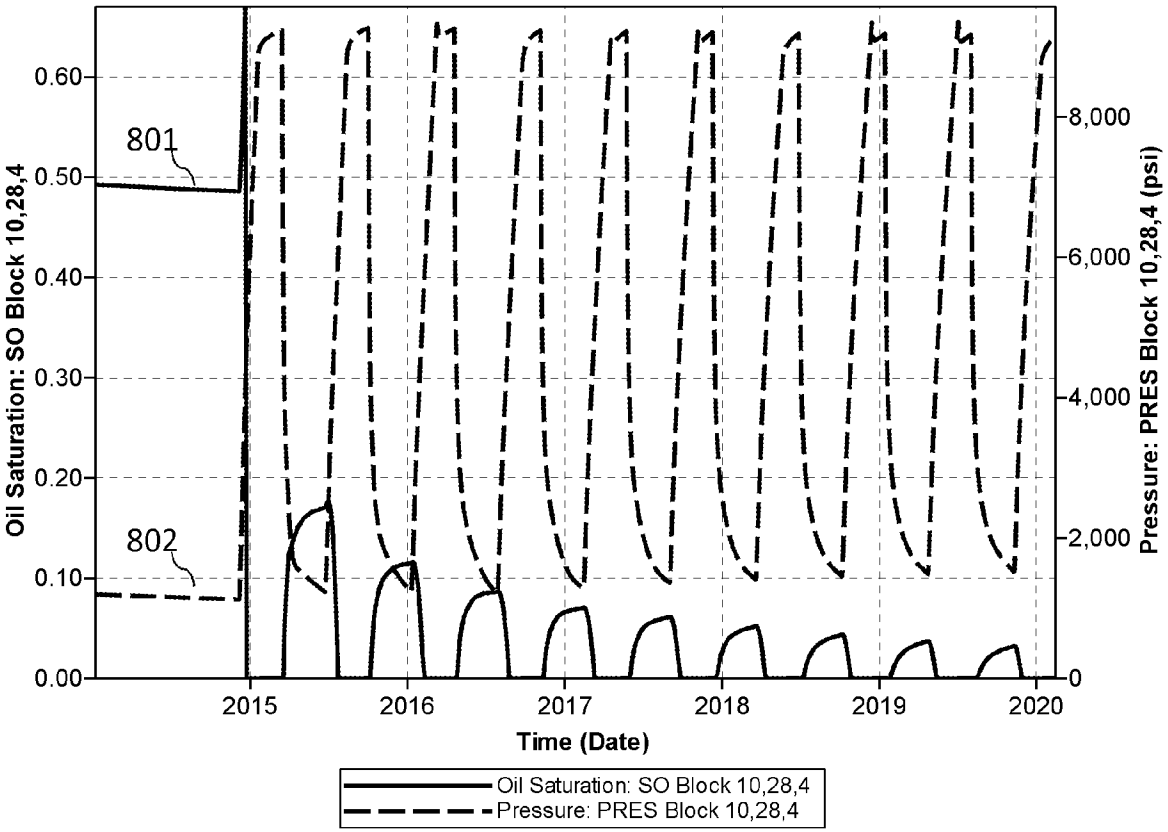
FIG. 8 shows the pressure and oil saturation near the producing fracture in the gas huff-n-puff process of the simulation that was set up as illustrated in FIGS. 9A-9B. Curves 801-802 show, respectively, the oil saturation SO Block (10, 28, 4) and pressure PRES Block (10, 28, 4).

FIG. 7 shows the pressures near the producing fracture of the simulation that was set up as illustrated in FIG. 3. FIG. 7 shows that the pressure in the gas huff-n-puff case (curve 703) fluctuated at high and low values following the huff and puff cycles. The pressures in the primary and gas flooding cases (curves 701 and 702, respectively) remained low. When the flowing bottom-hole pressure is below the dew point pressure, some liquid will drop out during the puff period. But the liquid will be "picked" up by injected dry gas (less heavy components) or mixed with dry gas during huff period. FIG. 8 shows the oil saturation and pressure near the producing fracture in the case of gas huff-n-puff (curves 801 and 802, respectively). FIG. 8 clearly shows that as the pressure declines, during the puff period, the oil saturation builds up; as the pressure is increased during the huff period, the oil saturation is decreased.

In conventional or tight reservoirs, gas flooding is used to maintain high pressure so that liquid oil and gas production can be achieved [Thomas 1995]. In cases of shale gas condensate reservoir (matrix permeability of 100 nD, e.g.), gas flooding did not result in higher liquid production. This was because the pressure near the injection well was very high, and this pressure could not propagate to the production end owing to very low permeability. The pressure near the producing fracture (Block (21, 28, 4) 905 as marked in FIG. 9B) in the gas flooding case was very low (about 1000 psi, as shown in FIG. 7), and the pressure near the injection fracture (Block (1, 28, 4) 903 as marked in FIG. 9A) is very high (9500 psi). This is clear in the pressure map at the end of 10 years of gas flooding, as shown in FIG. 9A. The pressure at the injection side 901 is at 9500 psi, while the pressure at the production side 902 is 500 psi. And there is a large area in between where the pressure is 4000-6000 psi.

The three scenarios were re-simulated by increasing the matrix permeability by 1000 times from 100 nD to 0.1 mD. The pressure map at the end of 10 years of gas flooding is shown in FIG. 9B. FIG. 9B shows that the pressure at the injection side 901 is about 2481 psi, and the pressure at the production side 902 is 500 psi. And the pressure gradually propagates from the injector to the producer. Note that in the case of 0.1 mD, the pressure near the injector cannot be built up to 9500 psi like the case of 100 nD, because the pressure is able to dissipate to the production end.

The three scenarios of primary, gas flooding and huff-n-puff were re-simulated for a tight formation of 0.1 mD (to show the difference between a conventional or tight reservoir). The results for these three cases are shown in TABLE 4.

TABLE 4

Performance comparison of different scenarios (0.1 mD)

| | Primary | Gas Flooding | Gas huff-n-puff | Ratio (B/A) |
|---|---|---|---|---|
| Total gas produced (MMSCF) | 427.22 | 7491.5 | 3989.4 | 0.53 |
| Gas injected (MMSCF) | 0 | 7200 | 3600 | 0.50 |
| Net gas produced (MMSCF) | 427.22 | 291.5 | 389.4 | 1.34 |
| Oil produced (MSTB) | 55.046 | 111.36 | 83.167 | 0.75 |
| Oil recovery factor (%) | 47.1 | 95.28 | 71.16 | 0.75 |
| Value of produced oil and gas (MM$) | 7.21348 | 12.302 | 9.8743 | 0.80 |

TABLE 4 shows that the oil recovery factor was the highest in the gas flooding case, and was twice that from the primary case. The oil recovery factor in the gas hug-n-puff case was lower than that in the gas flooding case. The revenues from produced oil and gas were in line with the oil recovery factors from these three scenarios. The performance difference in TABLE 3 and TABLE 4 shows that gas huff-n-puff is the preferred method to increase liquid oil production in shale gas condensate reservoirs, but may not in conventional or tight gas condensate reservoirs. The ratios of each parameter for the huff-n-puff scenario to that for the gas flooding scenario in TABLE 4 are all lower than one except for the net bas produced, compared with the ratios in TABLE 3 for a shale reservoir which are all greater than one.

As further verification of the present invention in liquid oil production is increased from gas condensate reservoirs, a series of parametric studies were conducted. The parameters studied include initial reservoir pressure, bottom-hole flowing pressure (BHFP), cycle time, soak time, gas compositions, and $CO_2$ injection.

For initial reservoir pressure, the dew point of the gas condensate in the base model was 3988 psi, and the initial reservoir pressure was 9088 psi. It is believed that when the initial reservoir pressure is close to the dew point, the huff-n-puff method is more effective compared to gas flooding and primary depletion. A lower reservoir pressure of 5000 psi was tested while keeping the dew point pressure unchanged. The results for the three scenarios are presented in TABLE 5.

TABLE 5

Performance at the initial reservoir pressure of 5000 psi

| | Primary | Gas Flooding | Gas huff-n-puff | Ratio (B/A) |
|---|---|---|---|---|
| Total gas produced (MMSCF) | 286.62 | 158.78 | 2125.8 | 13.39 |
| Gas injected (MMSCF) | 0 | 225.51 | 2010.1 | 8.91 |
| Net gas produced (MMSCF) | 286.62 | −66.73 | 115.7 | −1.73 |
| Oil produced (MSTB) | 17.832 | 15.446 | 23.418 | 1.52 |
| Oil recovery factor (%) | 18.969 | 16.43 | 24.911 | 1.52 |
| Value of produced oil and gas (MM$) | 2.92968 | 1.2777 | 2.8046 | 2.20 |

The ratios of oil recovery factors and values of produced oil and gas for the huff-n-puff scenario to those for the gas flooding scenario are all 1.52. These ratios at the initial reservoir pressure of 9088 psi (performance results in TABLE 3) are 1.28 and 1.33, respectively. Comparing these ratios at these two initial reservoir pressures, it can be seen that with lower initial reservoir pressure, the huff-n-puff shows higher potential of improved oil recovery (IOR) compared with gas flooding.

Figure 2:
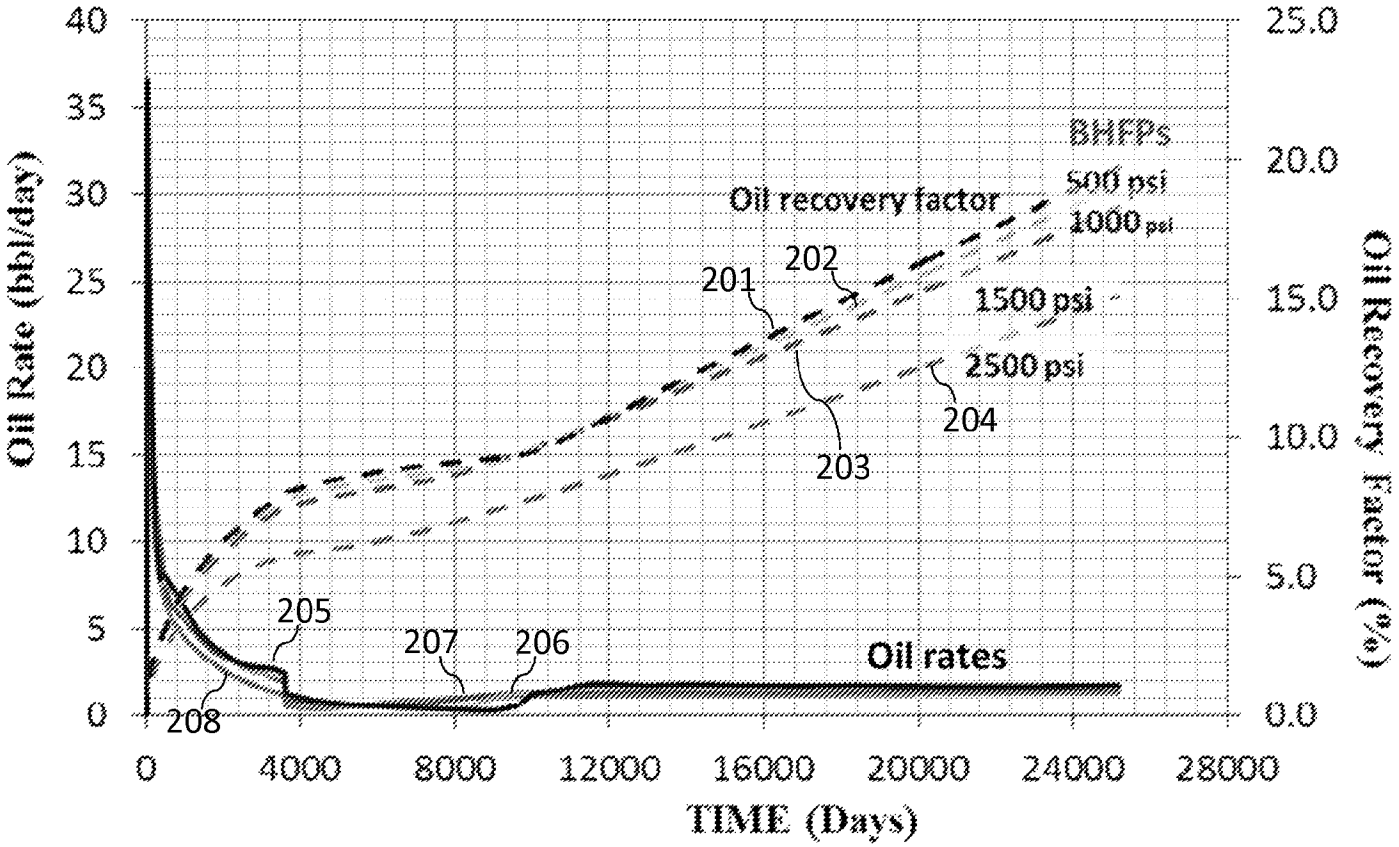
FIG. 2 is a graph showing oil rate and recovery at different bottom-hole flowing pressures (500 psi, 1000 psi, 1500 psi, and 2500 psi) (Sheng 2014). For 500 psi, 1000 psi, 1500 psi, and 2500 psi, these are respectively (a) oil recover factors curves 201-204 and (b) oil rates curves 205-208.

For the effect of bottom-hole flowing pressure (BHFP), as discussed above with regard to FIG. 2, the oil recovery in shale oil reservoirs is increased as BHFP is lowered because of larger driving energy. However, TABLE 6 shows that although the gas produced during the primary depletion is increased in shale gas condensate reservoirs, the oil recovery in both primary depletion and gas flooding increases with BHFP before reaching the dew point pressure (3988 psi in this studied reservoir), and decreases after the dew point.

TABLE 6

Oil recovery factors (%) at different BHFPs and different injection modes

| BHFP, psi | Primary gas, MMSCF | Primary oil | Gas flooding (A) | Huff-n-puff (B) | Ratio (B/A) |
|---|---|---|---|---|---|
| 500 | 357.01 | 26 | 31.23 | 39.93 | 1.28 |
| 1000 | 337.87 | 26.427 | 31.757 | 39.328 | 1.24 |
| 2000 | 285.84 | 27.97 | 33.813 | 38.805 | 1.15 |
| 4000 | 167.85 | 28.903 | 35.1 | 34.683 | 0.99 |
| 6000 | 85.132 | 15.272 | 19.972 | 25.322 | 1.27 |

This is because more liquid will drop out when the BHFP is farther below the dew point. The drawdown will be reduced when the BHFP is increased above the dew point. So the oil recovery factor decreases with BHFP. The ratio oil recovery factors of the huff-n-puff and flooding reaches the lowest point at the dew point pressure (close to 1).

Figure 10:
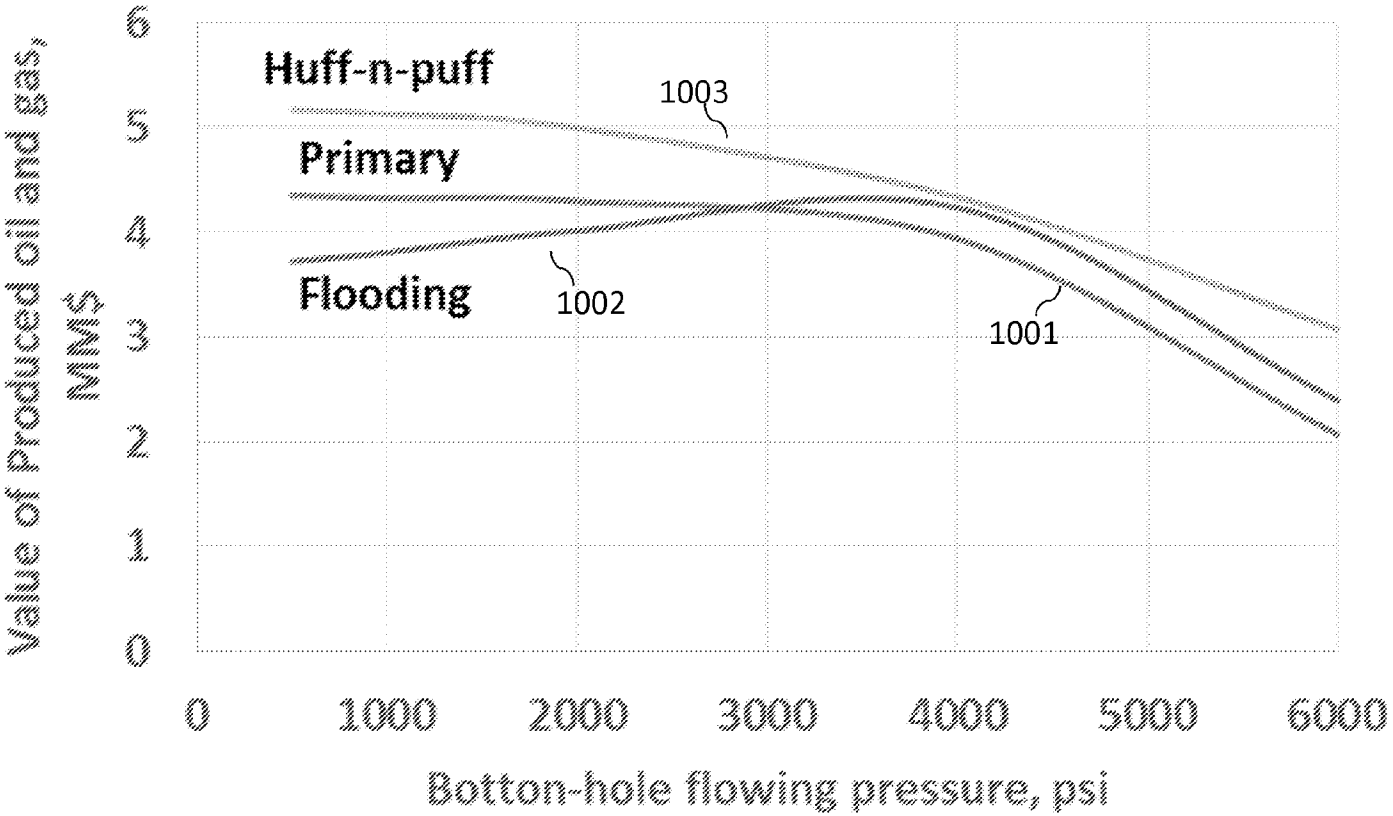
FIG. 10 is a graph showing the values of produced oil and gas change with BHFP in the different production modes. Curves 1001-1003 are the curves for primary, flooding, and huff-n-puff, respectively.

FIG. 10 shows the values of oil and gas produced in MM$ at different BHFPs (curves 1001-1003 respectively for primary, flooding, and huff-n-puff). The value decreases with BHFP in the primary depletion and the huff-n-puff. The value is at the highest at the dew point pressure, and the value increases in the huff-n-putt mode.

For cycle time effect, FIG. 7 shows that the pressure quickly decreases when the well is put in production, and quickly increases when the well is put in injection. After a short time of production or injection, either production or injection rate must quickly decrease. Therefore, reducing cycle time should accelerate production. TABLE 7 shows the results for different cycle times.

TABLE 7

Effect of cycle times

| | 200 d | 100 d | 50 d | 25 d |
|---|---|---|---|---|
| Total gas produced (MMSCF) | 2232.2 | 3133.7 | 3783.1 | 3814.4 |
| Gas injected (MMSCF) | 2161.6 | 3008.3 | 3621.5 | 3572 |
| Net gas produced (MMSCF) | 70.6 | 125.4 | 161.6 | 242.4 |
| Oil produced (MSTB) | 43.816 | 46.666 | 44.668 | 40.891 |
| Oil recovery factor (%) | 37.49 | 39.93 | 38.22 | 34.99 |
| Value of produced oil and gas (MM$) | 4.664 | 5.1682 | 5.1132 | 5.0587 |

Interestingly, the total gas produced follows this expectation, but the total oil produced does not. The data shows that the maximum oil is produced when the cycle time is at 100 days.

For soak time effect, in most of the cases, the puff period immediately follows the huff period. There is no soak time imposed because it is expected that miscibility or diffusion between the injected gas and in situ gas and condensate is fast.

To test this, the huff time of 100 days in the base case was split into 50 days of soak time and 50 days of injection time. In other words, during the 100 days, the first 50 days was used to inject gas, then the well was shut-in in the next 50 days. The case was "50 d shut-in, 100 d open" in TABLE 8.

TABLE 8

Effect of soak times

| Scenario | 100 d | 50 d shut-in, 100 d open | 50 d shut-in, 100 d open, diffusion |
|---|---|---|---|
| Total gas produced (MMSCF) | 3133.7 | 2017.9 | 2028.2 |
| Gas injected (MMSCF) | 3008.3 | 1798.2 | 1790.3 |
| Net gas produced (MMSCF) | 125.4 | 219.7 | 237.9 |
| Oil produced (MSTB) | 46.666 | 40.582 | 40.92 |
| Oil recovery factor (%) | 39.93 | 34.72 | 35.012 |
| Value of produced oil and gas (MM$) | 5.1682 | 4.937 | 5.0436 |

The results in TABLE 8 show that all the parameters are lower in this case compared to the base case without 50 days of soak time (the case "100 d" in the table), except the net gas produced. When the diffusion effect was added (in the case of "50 d shut-in, 100 d open, diffusion"), all the parameters are higher than those in the corresponding case without diffusion. However, the effect was minor, and those parameters were all lower than those in the base case. Only the molecular diffusion was considered. The molecular binary diffusion coefficients between components in the mixture are calculated using the Sigmund 1976 method.

For gas composition effect, the gas flooding and huff-n-puff were simulated with the injected gas composition of 85% $C_1$ and 15% $C_2$. The results are shown in TABLE 9.

TABLE 9

| Gas composition effect (85% $C_1$, 15% $C_2$) | | | | |
|---|---|---|---|---|
| | Primary | Gas flooding (A) | Huff-n-puff (B) | Ratio (B/A) |
| Total gas produced (MMSCF) | 357.01 | 273.680 | 3091.000 | 11.29 |
| Gas injected (MMSCF) | 0 | 211.290 | 2917.600 | 13.81 |
| Net gas produced (MMSCF) | 357.01 | 62.390 | 173.400 | 2.78 |
| Oil produced (MSTB) | 30.385 | 35.504 | 49.297 | 1.39 |
| Oil recovery factor (%) | 26 | 30.377 | 42.180 | 1.39 |
| Value of produced oil and gas (MM$) | 4.467 | 3.800 | 5.623 | 1.48 |
| Base case (100% $C_1$) | — | — | — | — |
| Oil recovery factor (%) | 26.000 | 31.230 | 39.93 | 1.28 |
| Value of produced oil and gas (MM$) | 4.467 | 3.886 | 5.17 | 1.33 |

For the ease of comparison, the oil recovery factor and value of produced oil and gas for the base case (100% $C_1$) are also listed. It is understood that as the injection gas composition was closer to the reservoir gas, the recovery was higher, as shown in this TABLE 9 for the huff-n-puff and gas flooding scenarios. Note the oil recovery factor for the gas mixture injection was slightly lower than that from 100% $C_1$. The ratios of oil recovery factors and values of produced oil and gas for the mixture of $C_1$ and $C_2$ are higher than those for the C1 only.

For $CO_2$ injection performance, several attempts have been made to evaluate $CO_2$ EOR potential in shale and tight oil reservoirs. [Shoaib 2009; Wang 2010; C Chen 2013; Want et al., 2013; Wan 2014; Gamadi 2014; Yu 2014]. Applicant believes that evaluation of $CO_2$ potential to improve liquid oil recovery from shale oil gas condensate reservoirs has not been seen in the literature. Shale reservoirs can serve as good $CO_2$ storage reservoirs. Therefore, to see the performance of $CO_2$ injection is of interest. TABLE 10 shows the oil recovery factors for $CO_2$ and $C_1$ injection.

TABLE 10

| $CO_2$ vs. $C_1$ injection | | | |
|---|---|---|---|
| | Gas flooding (A) | Huff-n-puff (B) | Ratio (B/A) |
| $C_1$ oil recovery factor (%) | 30.890 | 39.93 | 1.29 |
| $CO_2$ oil recovery factor (%) | 24.533 | 37.092 | 1.51 |

The oil recovery factor from the $CO_2$ huff-n-puff was higher than that from the $CO_2$ flooding. Interestingly, the oil recovery factor from $C_1$ flooding was higher than that from $CO_2$ flooding; and this observation is also true for the huff-n-puff cases.

Figure 11:
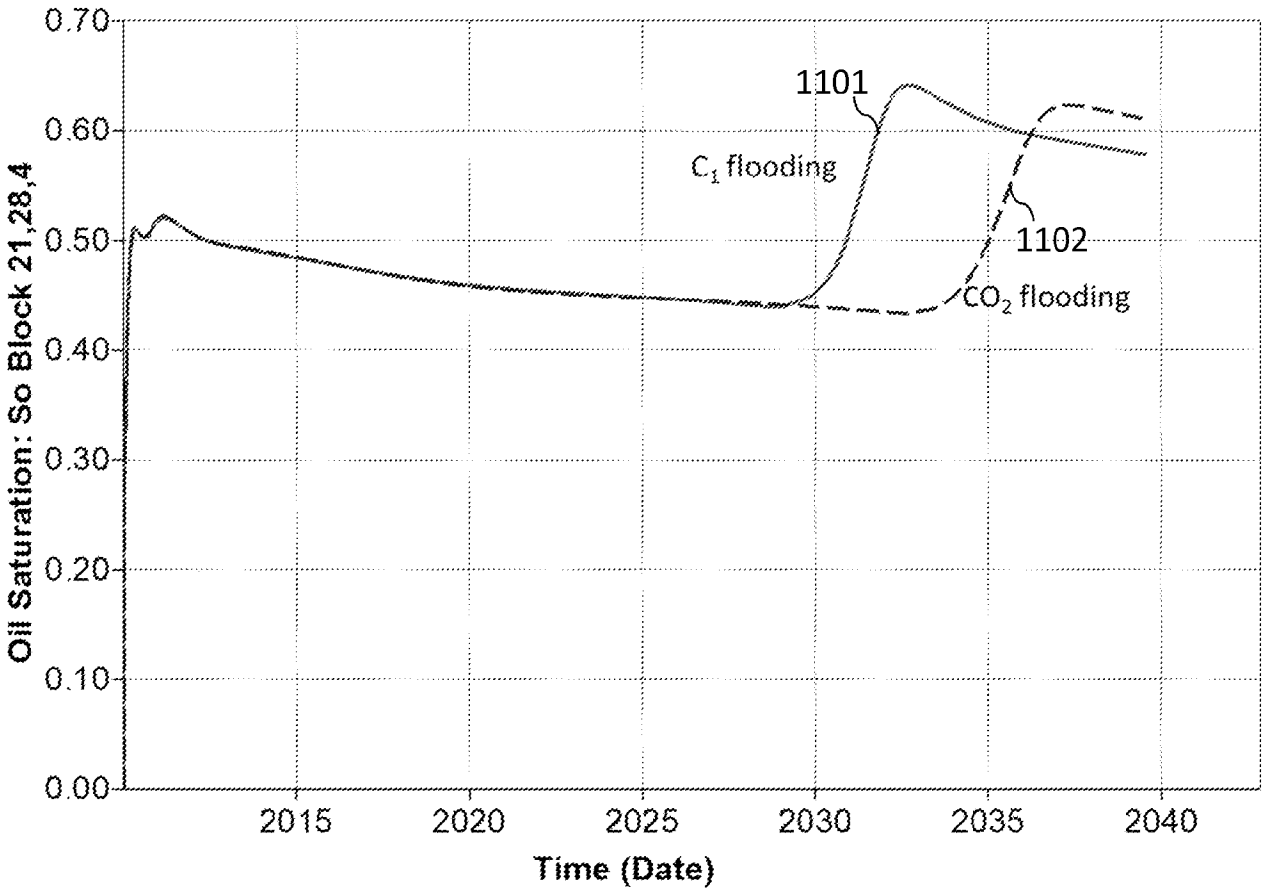
FIG. 11 is a graph showing oil saturation near the producing fractures in the $C_1$ flooding (curve 1101) and $CO_2$ flooding (curve 1102).
Figure 12:
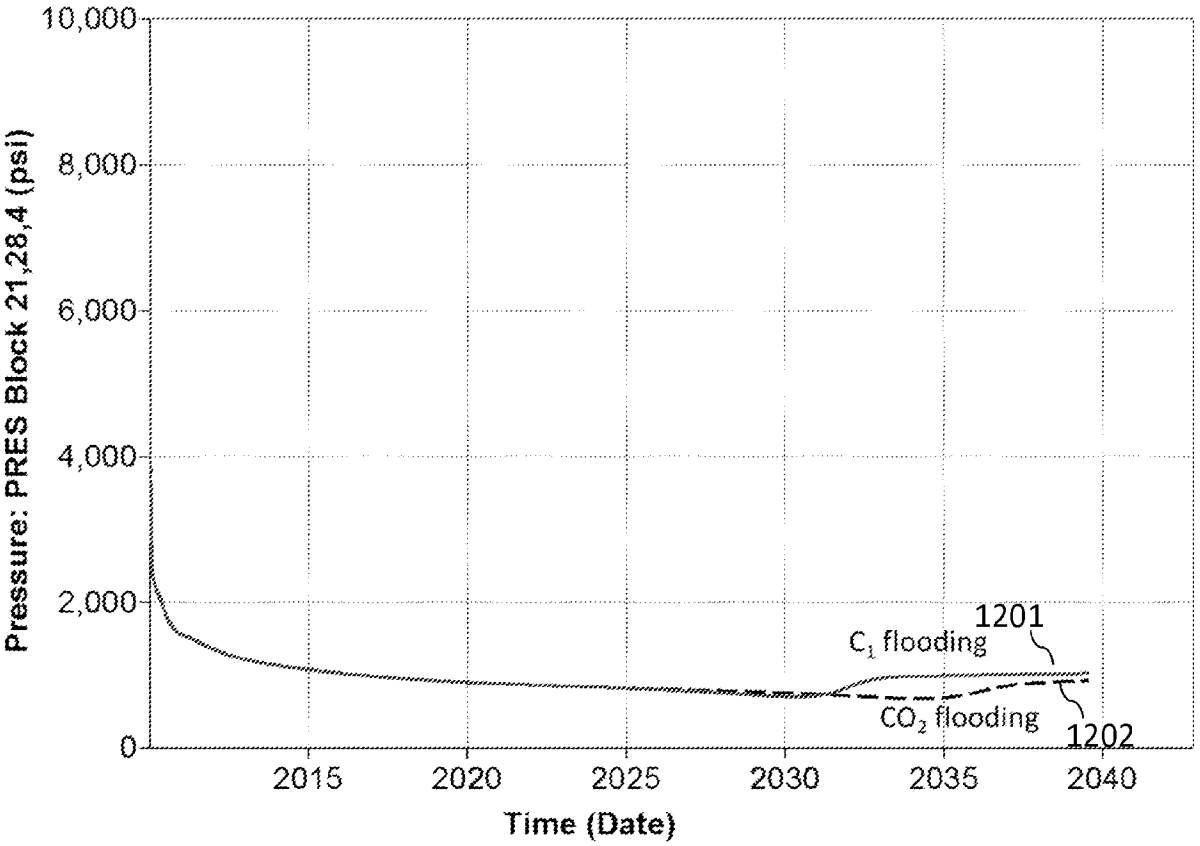
FIG. 12 is a graph showing pressure near the producing fractures in the $C_1$ flooding (curve 1201) and $CO_2$ flooding (curve 1202).

These observations can also be understood by comparing the flooding cases. FIGS. 11-12 show, respectively, the oil saturation and pressure near the producing fractures. In FIG. 11, the oil saturation near the producing fractures is shown for $C_1$ flooding (curve 1101) and $CO_2$ flooding (curve 1102). In FIG. 12, the pressure near the producing fractures is shown for $C_1$ flooding (curve 1201) and $CO_2$ flooding (curve 1202). These figures indicate that the pressure wave and the oil bank arrive later in the $CO_2$ flooding than in the $C_1$ flooding. Therefore, the cumulative oil produced in the $CO_2$ flooding was delayed. As an aside, there was a concern of formation damage owing to asphaltene deposition in shale reservoirs. [Shahriar 2014].

The examples provided herein are to more fully illustrate some of the embodiments of the present invention. It should be appreciated by those of skill in the art that the techniques disclosed in the examples which follow represent techniques discovered by the Applicant to function well in the practice of the invention, and thus can be considered to constitute exemplary modes for its practice. However, those of skill in the art should, in light of the present disclosure, appreciate that many changes can be made in the specific embodiments that are disclosed and still obtain a like or similar result without departing from the spirit and scope of the invention.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above.

Advantages of the using embodiments of the present invention include maximizing oil production rate, maximizing liquid oil offtake, and providing an alternative to the gas or water flooding methods that are not feasible for the low permeability shale reservoirs. Such technology of the present invention thus can be utilized by oil producers to maximize liquid oil production from its shale reservoirs.

RELATED PATENTS AND PUBLICATIONS

The following patents and publications relate to the present invention:

U.S. Pat. No. 4,390,068, "Carbon dioxide stimulated oil recovery process," issued Jun. 28, 1983 to Patton et al. ("Patton '068 patent").

U.S. Pat. No. 4,452,689, "Huff and puff process for retorting oil shale," issued Jun. 5, 1984 to Russum ("Russum '689 patent").

U.S. Pat. No. 5,381,863, "Cyclic huff-n-puff with immiscible injection and miscible production steps," issued Jan. 17, 1995 to Wehner ("Wehner '863 patent").

U.S. Pat. No. 5,725,054, "Enhancement of residual oil recovery using a mixture of nitrogen or methane diluted with carbon dioxide in a single-well injection process," issued Mar. 10, 1998 to Shayegi et al. ("Shayegi '054 patent").

U.S. Pat. No. 6,244,431, "Huff and puff process utilizing nitrogen gas," issued Jun. 12, 2001 to Miller ("Miller '431 patent").

Aziz, R. M. A. 1982. Critique on gas cycling operations on gas-condensate reservoirs, paper SPE11477 presented at the Middle East Oil Technical Conference of the Society of Petroleum Engineers held in Manama, Bahrain. March 14-17 ("Aziz 1982").

Chaback J. J. and Williams, M. L. 1994. p-x Behavior of a rich-gas condensate in admixture with CO2 and (N2+CO2), SPERE, 9(1), 44-50 ("Chaback 1994").

Chen, C., Balhoff, B., Mohanty, K. K., 2013. Effect of Reservoir Heterogeneity on Improved Shale Oil Recovery by $CO_2$ Huff-n-Puff, SPE 164553-MS, presented at 2013 SPE Unconventional Resources Conference, Woodlands, Tex., USA, 10-12 April ("C Chen 2013").

Chen, K. 2013. Evaluation of EOR Potential by Gas and Water Injection in Shale Oil Reservoirs, Masters thesis, Texas Tech University, May ("K Chen 2103").

Gamadi, T. D., Sheng, J. J., and Soliman, M. Y. 2013. An Experimental Study of Cyclic Gas Injection to Improve Shale Oil Recovery, paper SPE 166334 presented at the SPE Annual Technical Conference and Exhibition held in New Orleans, La., USA, 30 September-2 October ("Gamadi 2013").

Gamadi, T. D., Sheng, J. J., and Soliman, M. Y, Menouar, H., Watson, M. C., Emadibaladehi, H. 2014. An Experimental Study of Cyclic $CO_2$ Injection to Improve Shale Oil Recovery, paper SPE 169142 presented at the SPE Improved Oil Recovery Symposium, 12-16 April, Tulsa, Okla. ("Gamadi 2014").

Goricnik B., Sarapa, M., and Csisko, M. 1995. Phase equilibria in a rich-gas condensate-CO2 and natural gas mixtures, NAFTA, 46(9), 371-377 ("Goricnik 1995").

Hernandez, I., Farouq Ali, S. M., and Bentsen, R. G. 1999. First Steps for Developing an Improved Recovery Method for a Gas Condensate Reservoir, paper PETSOC 95-09 presented at the Annual Technical Meeting of Petroleum Society of Canada, June 14-18, Calgary, Alberta ("Hernandez 1999").

Juell, A. O. and Whitson, C. H. 2013. Optimized Well Modeling of Liquid-Rich Shale Reservoirs, paper SPE 166380 presented at the SPE Annual Technical Conference and Exhibition, 30 September-2 October, New Orleans, La., USA ("Juell 2013").

Orangi, A., Nagarajan, N. R., Honarpour, M. M., Rosenzweig, J. 2011. Unconventional Shale Oil and Gas-Condensate Reservoir Production, Impact of Rock, Fluid, and Hydraulic Fractures. Paper 140536 presented at SPE Hydraulic Fracturing Technology Conference, Jan. 24-26, 2011, The Woodlands, Tex., USA ("Orangi 2011").

Rubin, B. 2010. Accurate Simulation of Non Darcy Flow in Stimulated Fractured Shale Reservoirs. paper SPE 132093 presented at the SPE Western Regional Meeting, 27-29 May, Anaheim, Calif. ("Rubin 2010").

Shahriar, M. 2014. Aggregation of Asphaltene Molecules as a Function of Carbon Dioxide Concentration, PhD dissertation, Texas Tech University, August ("Shahriar 2014").

Shoaib, S., Hoffman, B. T. 2009. $CO_2$ Flooding the Elm Coulee Field, SPE-123176-MS presented at the SPE Rocky Mountain Petroleum Technology Conference, 14-16 April, Denver, Colo. ("Shoaib 2009")

Sheng, J. J. 2011. Modern Chemical Enhanced Oil Recovery: Theory and Practice, Elsevier ("Sheng 2011")

Sheng, J. J. and Chen, K. 2014. Evaluation of the EOR Potential of Gas and Water Injection in Shale Oil Reservoirs, *Journal of Unconventional Oil and Gas Resources,* 5, 1-9 ("Sheng 2014").

Sigmund, P. M. 1976 Prediction of Molecular Diffusion at Reservoir Conditions Part 1—Measurement and Prediction of Binary Dense Gas Diffusion Coefficients. JCPT 15 (2): 48-57 ("Sigmund 1976").

Smith L. R. and Yarborough L. 1968. Equilibrium Revaporization of retrograde condensate by dry gas injection, SPEJ, 8(1), 87-94 ("Smith 1968").

Standing, M. B., Lindblad, E. N., and Parsons, R. L. 1948. Calculated Recoveries by Cycling from a Retrograde Reservoir of Variable Permeability, Trans. AIME, 174(1), 165-190 ("Standing 1948").

Thomas, F. B., Zhou, X., Bennion, D. B., Bennion, D. W. 1995. Towards Optimizing Gas Condensate Reservoirs, paper PETSOC 95-09 presented at the Annual Technical Meeting of Petroleum Society of Canada, Jun. 7-9, 1995, Calgary, Alberta ("Thomas 1995").

Transparency Market Research (TMR). April 2014. Enhanced Oil Recovery (EOR) Market: Global Industry Analysis, Size, Share, Growth, Trends and Forecast, 2013-2023. ID 2829851 ("TMR 2014").

Wan, T., Sheng, J. J., and Soliman, M. Y. 2013. Evaluation of the EOR Potential in Shale Oil Reservoirs by Cyclic Gas Injection, paper SPWLA-D-12-00119 presented at the SPWLA 54th Annual Logging Symposium held in New Orleans, La., 22-26 June ("Wan 2013 A").

Wan, T., Sheng, J. J., and Soliman, M. Y. 2013 Evaluation of the EOR Potential in Fractured Shale Oil Reservoirs by Cyclic Gas Injection, paper SPE 168880 or URTeC 1611383 presented at the Unconventional Resources Technology Conference held in Denver, Colo., USA, 12-14 Aug. 2013 ("Wan 2013 B").

Wan, T., Meng, X., Sheng, J. J., Watson, M. 2014 Compositional Modeling of EOR Process in Stimulated Shale Oil Reservoirs by Cyclic Gas Injection, paper SPE 169069 presented at the SPE Improved Oil Recovery Symposium, 12-16 April, Tulsa, Okla. ("Wan 2014").

Wang, X., Luo, P., Er, V. Huang, S. 2010. Assessment of CO2 Flooding Potential for Bakken Formation, Saskatchewan, paper SPE-137728-MS presented at the Canadian Unconventional Resources and International Petroleum Conference, 19-21 October, Calgary, Alberta, Canada ("Wang 2010").

Weinaug C. P. and Cordell J. C. 1949. Revaporization of butane and pentane from sand, Trans. AIME, 179(1), 303-312 ("Weinaug 1949").

Yu, W., Lashgari, H., Sepehrnoori, K. 2014. Simulation Study of CO2 Huff-n-Puff Process in Bakken Tight Oil Reservoirs, paper SPE 169575-MS presented at the SPE Western North American and Rocky Mountain Joint Meeting, 17-18 April, Denver, Colo. ("Yu 2014").

The disclosures of all patents, patent applications, and publications cited herein are hereby incorporated herein by reference in their entirety, to the extent that they provide exemplary, procedural, or other details supplementary to those set forth herein.

What is claimed is:

1. A method of producing fluids comprising hydrocarbons from a reservoir formation in a shale gas condensate reservoir with a huff-n-puff process comprising injecting gas to the reservoir through a well during a huff period and producing the fluids from the well during a puff period, wherein the method comprises the steps of:

(a) determining dew point pressure of the fluids in the reservoir formation to obtain a determined dew point pressure of the fluids in the reservoir formation;

(b) injecting the gas during the huff period of the huff-n-puff process from surface level of the well downhole into a wellbore of the well such that the injected gas flows from bottom-hole into the reservoir formation, wherein the step of injecting occurs over a first time period of a cycle period;

(c) producing the fluids during the puff period of the huff-n-puff process from the same wellbore by flowing the fluids from the reservoir formation into the bottom hole and up hole to the surface level, wherein (i) bottom hole flowing pressure is below the determined dew point pressure of the fluids in the reservoir formation, and (ii) the production of the fluids occurs over a second time period of the cycle period; and (d) repeating steps (b) and (c) for a plurality of cycle periods.

2. The method of claim 1, wherein the hydrocarbons are liquid oil.

3. The method of claim 1, wherein permeability of the reservoir formation is at most 50 mD.

4. The method of claim 3, wherein the permeability is at most 0.1 mD.

5. The method of claim 3, wherein the permeability is at most 100 nD.

6. The method of claim 1, wherein the gas is selected from the group consisting of methane, natural gas, carbon dioxide, nitrogen, and combinations thereof.

7. The method of claim 1, wherein the gas comprises methane.

8. The method of claim 1, wherein the gas comprises carbon dioxide.

9. The method of claim 1, wherein pressure at which the gas is injected into the reservoir formation is below fracture pressure of the reservoir formation.

10. The method of claim 1, wherein each cycle period in the plurality of cycle periods is at most 200 days.

11. The method of claim 10, wherein each cycle period in the plurality of cycle periods is between 25 and 100 days.

12. The method of claim 1 further comprising selecting durations of the first time period and the second time period based upon a parameter selected from the group consisting of permeability of the reservoir formation, composition of the gas, composition of the fluids in the reservoir formation, the dew point pressure of the fluids in the reservoir formation, the bottom-hole flowing pressure, production rate, bottom-hole injection pressure, bottom-hole injection rate, facility constraints, economic parameters, and combinations thereof.

13. The method of claim 12, wherein the parameter comprises an economic parameter of net present value of the fluids produced.

14. The method of claim 1, wherein there is no soaking period between the first time period and the second time period.

15. The method of claim 1, wherein there is a soak period between the first time period and the second time period.

16. The method of claim 15, wherein the soak period is for a period of time that is at most the time of the first time period.

17. The method of claim 1, wherein (a) the hydrocarbons are liquid oil; and (b) (i) the production of the liquid oil from the wellbore using the method of claim 1 to (ii) production of liquid oil from the wellbore before using the method of claim 1 on the well is at a liquid oil ratio of least around 1.2.

18. The method of claim 17, wherein the liquid oil ratio is at least around 1.5.

19. The method of claim 1, wherein (a) the hydrocarbons are liquid oil;

(b) the fluids comprise gas;

(c) (i) production of net gas from the wellbore using the method of claim 1 to (ii) production of gas from the wellbore before using the method of claim 1 on the well is at a gas ratio of least around 1.3 and, (d) the net gas is the amount of the gas produced during the second time period less the amount of the gas injected during the first time period.

20. The method of claim 19, wherein the gas ratio is at least around 2.

21. The method of claim 1, wherein the bottom hole flowing pressure is at most 2500 psi.

22. The method of claim 1, wherein the bottom hole flowing pressure is at most 500 psi.

23. The method of claim 1, wherein, for each cycle period in the plurality of cycle periods, duration of the first time period is the same as duration of the second time period.

24. The method of claim 1, wherein (a) duration of the first time periods is the same for each cycle period in the plurality of cycle periods, and (b) duration of the second time periods is the same for each cycle period in the plurality of cycle periods.

25. The method of claim 1, wherein (a) duration of at least some of the first time periods is different for each cycle period in the plurality of cycle periods, and (b) duration of at least some of the second time periods is different for each cycle period in the plurality of cycle periods.

* * * * *